US007272921B2

(12) United States Patent
Misrachi

(10) Patent No.: US 7,272,921 B2
(45) Date of Patent: Sep. 25, 2007

(54) WIRE ROPE WITH GALVANIZED OUTER WIRES

(75) Inventor: Joseph Misrachi, Cote St. Luc (CA)

(73) Assignee: Wire Rope Industries Ltd., Pointe-Claire, Quebec (CA)

( * ) Notice: Subject to any disclaimer, the term of this patent is extended or adjusted under 35 U.S.C. 154(b) by 0 days.

(21) Appl. No.: 11/389,590

(22) Filed: Mar. 27, 2006

(65) Prior Publication Data

US 2006/0228547 A1 Oct. 12, 2006

(30) Foreign Application Priority Data

Apr. 12, 2005 (CA) ..... 2504394

(51) Int. Cl.
*D02G 3/02* (2006.01)
*D02G 3/32* (2006.01)

(52) U.S. Cl. ..... 57/237; 57/210

(58) Field of Classification Search ..... 57/212, 57/231, 217, 221, 223, 230, 232
See application file for complete search history.

(56) References Cited

U.S. PATENT DOCUMENTS

| | | | | |
|---|---|---|---|---|
| 4,120,145 | A | 10/1978 | Chiappetta et al. | |
| 4,197,695 | A * | 4/1980 | Hughes et al. | 57/7 |
| 4,202,164 | A | 5/1980 | Simpson et al. | |
| 4,716,673 | A * | 1/1988 | Williams et al. | 42/95 |
| 4,870,814 | A | 10/1989 | Chacko et al. | |
| 6,295,799 | B1 * | 10/2001 | Baranda | 57/221 |
| 2004/0098963 | A1 * | 5/2004 | Calleeuw et al. | 57/232 |

FOREIGN PATENT DOCUMENTS

| | | |
|---|---|---|
| CA | 1208863 | 8/1986 |
| CA | 1305597 | 7/1992 |

* cited by examiner

*Primary Examiner*—Shaun R. Hurley
(74) *Attorney, Agent, or Firm*—George J. Primak

(57) ABSTRACT

A wire rope which has an independent wire rope core (IWRC) and outer strands laid around the core. This wire rope has an improved fatigue life when the outer wires of the core and of the outer strands are galvanized. The wire rope may be either fully or partially impregnated with plastic, if desired.

8 Claims, 2 Drawing Sheets

WIRE ROPE WITH GALVANIZED OUTER WIRES

FIELD OF THE INVENTION

This invention relates to a wire rope construction in which the wire rope is made of an independent wire rope core (IWRC) around which are laid a plurality of outer wire strands which may be plastic filled. More particularly, the invention provides a wire rope in which the outer wires of both the IWRC and of the outer strands are galvanized, while the remaining wires remain bright (i.e. clean).

BACKGROUND OF THE INVENTION

It is known to galvanize wires in stranded wire products as well as cables to provide protection against corrosion. Sometimes, this is supplemented by additional corrosion resistant coatings as disclosed, for instance, in U.S. Pat. No. 4,870,814.

It is also known to use galvanized wires in some plastic impregnated wire ropes as disclosed in applicant's own Canadian Patent No. 1,305,597. Galvanized wire is, however, seldom used in wire rope because of the additional cost involved and because of the rather limited protection against corrosion that it provides when it is not provided with additional anti-corrosive coatings as mentioned in the preceding paragraph.

SUMMARY OF THE INVENTION

According to the present invention, it was surprisingly found that considerable increase in the life of the wire rope may be obtained when only the outer wires of the IWRC and of the outer strands are galvanized, while keeping the remaining wires bright, namely as regular non-galvanized steel wires. Such construction was found to increase the cost of the wire rope by less than 15%, while increasing its fatigue life by more than 30%.

Thus, according to one embodiment of the invention, there is provided a wire rope comprising an independent wire rope core, the outer wires of which are galvanized wires, and a plurality of strands laid around said core in which the outer wires are galvanized wires, while the remaining wires within the independent wire rope core and the outer strands remain bright wires.

The reason for the improvement in the fatigue life of the wire rope galvanized in accordance with the present invention is believed to be due to the fact that when such wire rope is subjected to working conditions, it will be the galvanized wire that will contact each other most and their galvanization will protect the making steel surfaces from contact abrasion to a far greater extend than if the outer wires were non-galvanized or bright.

In a further embodiment, in addition to the outer wires of the IWRC core, the outer wires of any internal strands of the core may also be galvanized since during working of the wire rope, they may also come into contact with the outer wires of the other strands of the IWRC wound around them.

Thus, in essence, the present invention may include any wire rope construction where the outer wires of any or all strands that come into contact with each other while the wire rope is in operation, are galvanized so as to protect them from contact abrasion. It should be noted that the term "galvanized" includes any type of coating of the wires with zinc or zinc alloys, such as Galfan™, for the purpose of protecting them from contact abrasion.

Such wire ropes may be either regular type ropes, which are lubricated with a typical lubricant used in wire ropes, such as an asphaltic base lubricant, or they may be either fully or partially plastic filled or impregnated ropes as disclosed, for instance, in applicant's Canadian patent No. 1,208,863 or in U.S. Pat. Nos. 4,120,145 or 4,202,164.

BRIEF DESCRIPTION OF THE DRAWINGS

The invention will now be disclosed, by way of example, with reference to the accompanying drawings in which.

DESCRIPTION OF THE PREFERRED EMBODIMENTS

Figure 1:
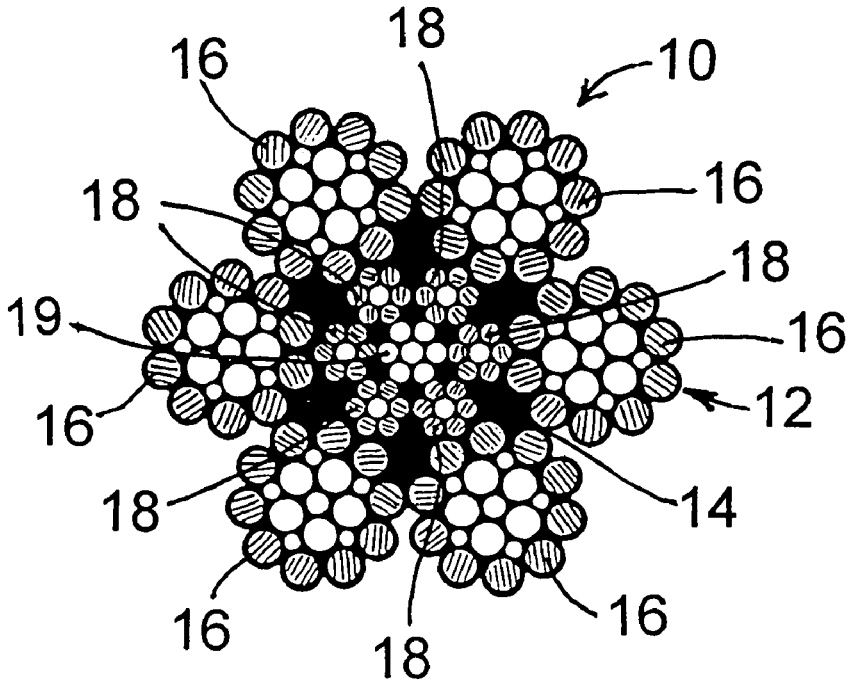
FIG. 1 is a cross-section view of a regular type wire rope in which the outer wires of the IWRC and of the surrounding strands are galvanized.

In the drawings, the same features are identified by the same reference numbers.

Referring to FIG. 1, it illustrates a regular wire rope 10 with an IWRC around which are laid outer strands 12. This wire rope is lubricated with an asphaltic lubricant 14 both within the IWRC and between the IWRC and the outer strands. According to the present invention, the outer wires of the outer strands 12 and the outer wires 18 of the IWRC are galvanized steel wires, whereas the remaining wires remain standard type steel wires which are also called bright wires. In a further embodiment of the invention, the outer wires 19 of the middle strand within the IWRC may also be galvanized wires.

Figure 2:
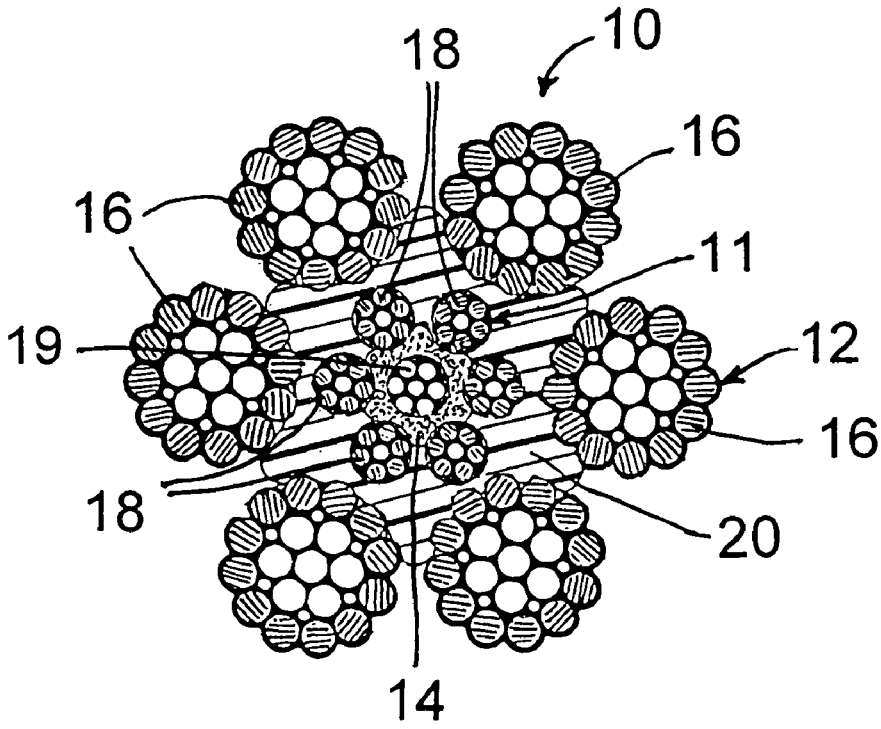
FIG. 2 is a cross-section view of a wire rope with a plastic impregnated IWRC, in which the outer wires of the IWRC and of the surrounding strands are galvanized.

Referring to FIG. 2, it illustrates a wire rope 10 in which the IWRC 11 is encapsulated with a plastic material 20. The core itself is lubricated with a standard lubricant 14 and the outer strands are wound around the IWRC and pressed into the plastic surrounding the core. This type of wire rope is called Cushion Core®. According to the invention, the outer wires 16 of the outer strands 12 and the outer wires 18 of the IWRC 11 are made of galvanized wires. In a further embodiment of the invention, the outer wires 19 of the middle strand within the IWRC may also be galvanized wires.

Figure 3:
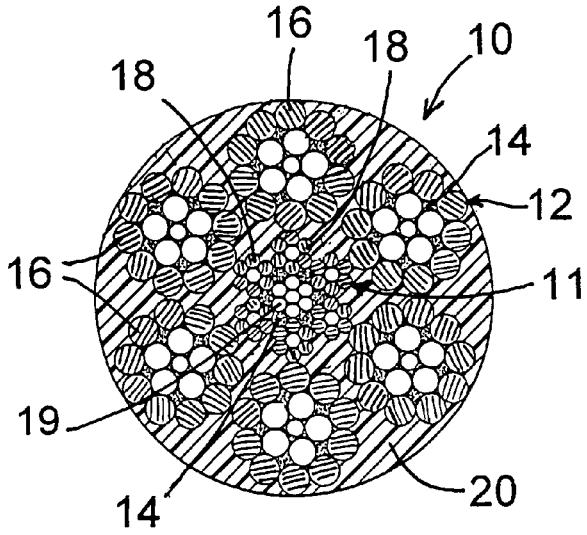
FIG. 3 is a cross-section view of a plastic impregnated wire rope where plastic impregnation extends from the IWRC to the outer periphery of the rope, and in which the outer wires of the IWRC and of the surrounding strands are galvanized.

In FIG. 3, there is illustrated a plastic impregnated wire rope 10 where the plastic material 20 penetrates up to the IWRC 11, but not within the IWRC itself, which is merely lubricated with lubricant 14. The outer strands are also lubricated therewithin with lubricant 14. According to the invention, the outer wires 16 of the outer strands and the outer wires 18 of the IWRC are made of galvanized steel wires. In a further embodiment of the invention, the outer wires 19 of the middle strand within the IWRC may also be galvanized wires.

Figure 4:
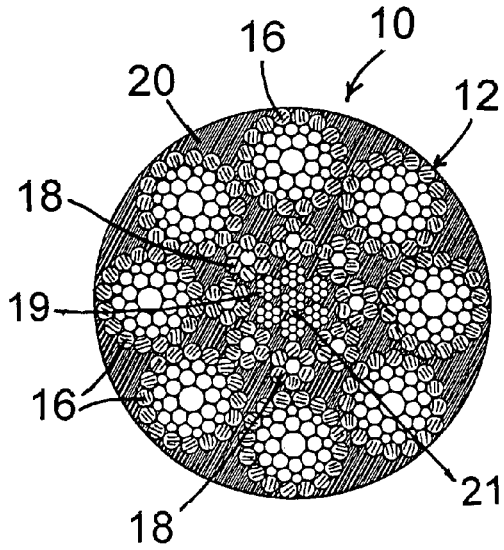
FIG. 4 is a cross-section of a fully plastic impregnated wire rope where the plastic penetrates all the way into the IWRC and in which the outer wires of the IWRC and of the surrounding strands are galvanized.
Figure 5:
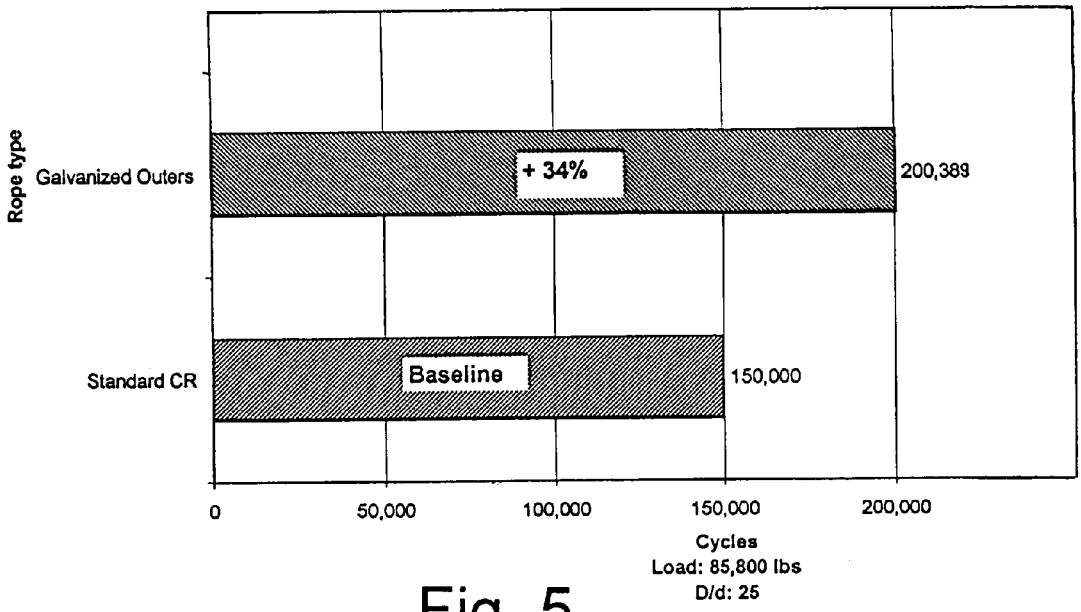
FIG. 5 is a graph showing the average fatigue life of the wire rope illustrated in FIG. 4 as compared with the same rope which has no galvanized wires in it.

In FIG. 4, there is illustrated a fully plastic filled wire rope 10 which is also called Cushion Rope®. In this rope, the plastic material impregnates the entire rope, including the IWRC. According to the invention, the outer wires 16 of the outer strands 12 and the outer wires 18 of the IWRC are made of galvanized steel wires, while the remaining wires remain bright. This particular rope was subjected to a fatigue bend-over-sheave test. The rope used was a 1¾" (43.75 mm) 8×37 rope with a right length lay (RLL). The sheave diameter D to the rope diameter d ratio was D/d=25 and the test load was 85,800 lbs (38,610 kg). The standard polypropylene filled wire rope using bright wires, namely Cushion Rope® (CR) resulted in 150,000 bending cycles until strand failure was recorded, whereas the same wire rope with galvanized outers in the core and the outer strands, resulted in 200,389 cycles before failure in the strands was detected. Thus, the rope in accordance with the present invention, having galvanized outer wires in the IWRC and in the outer strands produced an increase of 34% in the average fatigue life of the rope. This is illustrated by the graph shown in FIG. 5. As already previously mentioned, it is believed that the reason for this is that when the rope is subjected to working conditions, it is the outer wires of the outer strands and the outer wires of the IWRC that will get into steel-to-steel contact and this produces wear and abrasion which speed up the conditions that lead to the rope failure. If these outer wires are protected by galvanization, this creates a barrier that protects these mating steel surfaces from contact abrasion, and thus the fatigue life of the wire rope is significantly extended. In a further embodiment of the invention, the outer wires 19 of the first layer of strands directly under the outer layer of the IWRC strands may also be galvanized and further the outer wires 21 of the middle strand of the IWRC may equally be galvanized so as to reduce to the greatest possible extent contact abrasion between such wires without galvanizing all the wires within the rope.

It should be understood that the invention is not limited to the specific embodiments described and illustrated herein, and various modifications obvious to those skilled in the art may be made without departing from the invention and the scope of the following claims.

The invention claimed is:

1. A wire rope comprising an independent wire rope core (IWRC) having inner and outer wires, and outer strands laid around said core, characterized in that the outer wires of the IWRC and of the outer strands are galvanized, while the remaining wires within the IWRC and the outer strands remain bright wires.

2. A wire rope according to claim 1, in which the outer wires of any internal strands within the IWRC are also galvanized, while the remaining wires of said internal strands remain bright.

3. A wire rope according to claim 1, in which the core is impregnated with plastic.

4. A wire rope according to claim 2, in which the core is impregnated with plastic.

5. A wire rope according to claim 1, which is plastic impregnated outside the core.

6. A wire rope according to claim 2, which is plastic impregnated outside the core.

7. A wire rope according to claim 1, which is fully filled with plastic.

8. A wire rope according to claim 2, which is fully filled with plastic.

* * * * *